US009170546B2

(12) United States Patent
Mochizuki

(10) Patent No.: US 9,170,546 B2
(45) Date of Patent: Oct. 27, 2015

(54) IMAGE FORMING APPARATUS FOR PERFORMING AN ADJUSTMENT BASED ON DETECTED IMAGE DATA

(71) Applicant: CANON KABUSHIKI KAISHA, Tokyo (JP)

(72) Inventor: Jun Mochizuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/717,291

(22) Filed: Dec. 17, 2012

(65) Prior Publication Data

US 2013/0156452 A1 Jun. 20, 2013

(30) Foreign Application Priority Data

Dec. 19, 2011 (JP) ..... 2011-277690

(51) Int. Cl.
*G03G 15/00* (2006.01)
*G03G 15/01* (2006.01)

(52) U.S. Cl.
CPC ..... *G03G 15/556* (2013.01); *G03G 15/0189* (2013.01); *G03G 15/5058* (2013.01)

(58) Field of Classification Search
CPC ..... G03G 15/556; G03G 15/0189; G03G 15/5058
USPC ..... 399/46, 48–51, 66, 74
See application file for complete search history.

(56) References Cited

U.S. PATENT DOCUMENTS

| | | | | |
|---|---|---|---|---|
| 6,421,508 | B2 * | 7/2002 | Inoue et al. | 399/44 |
| 6,564,021 | B1 * | 5/2003 | Nakai et al. | 399/49 |
| 6,904,245 | B2 * | 6/2005 | Mochizuki et al. | 399/49 |
| 6,990,300 | B2 * | 1/2006 | Saito et al. | 399/101 |
| 7,292,798 | B2 * | 11/2007 | Furukawa et al. | 399/49 |
| 7,466,933 | B2 * | 12/2008 | Furukawa | 399/66 |
| 8,068,755 | B2 * | 11/2011 | Kojima | 399/66 |
| 2008/0193151 | A1 * | 8/2008 | Shim et al. | 399/40 |
| 2011/0293301 | A1 * | 12/2011 | Hayakawa | 399/44 |
| 2012/0189333 | A1 * | 7/2012 | Koshimura et al. | 399/49 |

FOREIGN PATENT DOCUMENTS

| | | |
|---|---|---|
| JP | 2001-166558 A | 6/2001 |
| JP | 2002-357937 A | 12/2002 |

* cited by examiner

*Primary Examiner* — Clayton E Laballe
*Assistant Examiner* — Trevor J Bervik
(74) *Attorney, Agent, or Firm* — Canon USA, Inc. IP Division

(57) ABSTRACT

Image forming apparatus includes a movable image bearing member, a first image forming unit, a second image forming unit, a detection member, an execution unit and an adjustment unit. A toner image for adjustment formed on an upstream photoreceptor is made to pass a photoreceptor while facing an area exposed by a downstream image forming unit and is detected by a detection unit.

8 Claims, 7 Drawing Sheets

ELECTRICAL DISCHARGE OCCUR

IMAGE FORMING APPARATUS FOR PERFORMING AN ADJUSTMENT BASED ON DETECTED IMAGE DATA

BACKGROUND OF THE INVENTION

1. Field of the Invention

The present invention relates to image forming apparatus, such as a copier and a printer. More particularly, the present invention relates to image forming apparatus in which density correction single-color and multi-color is performed.

2. Description of the Related Art

There is image forming apparatus which includes a plurality of photoreceptors and an intermediate transfer member. Each photoreceptor is exposed and carries a toner image. The intermediate transfer member functions as an image bearing member which carries the toner image transferred from each photoreceptor. In this configuration, it is effective to adjust a condition under which an image is formed in accordance with a detection result after detecting a toner image for adjustment on an intermediate transfer member for adjusting density of the image. If the toner image for adjustment is made to overlap a toner image for adjustment of another color, toner is not able to be detected for each color. Then, the toner image for adjustment is formed so as not to overlap the toner image of another color on the intermediate transfer member. That is, when passing a downstream photoreceptor ("second photoreceptor") after being transferred to the intermediate transfer member, a toner image for adjustment formed on an upstream photoreceptor ("first photoreceptor") faces an area of the second photoreceptor in which no toner image is formed, i.e., an area which has not been exposed.

If a color image is to be formed on a recording material, a toner image is made to overlap a toner image of another color to express secondary color. That is, when passing the downstream photoreceptor ("second photoreceptor") after being transferred to the intermediate transfer member, the toner image formed on the upstream photoreceptor ("first photoreceptor") faces an area of the second photoreceptor in which the toner image is formed, i.e., an area which has been exposed.

However, electrical potential of the exposed area differs from the potential of the unexposed area. Therefore, an amount of toner image which is retransferred from an intermediate transfer belt to the photoreceptor when the toner image passes the photoreceptor is changed depending on whether the toner image faces the exposed area or faces the unexposed area. Then, in Japanese Patent Laid-Open No. 2001-166558, an apparatus is described in which, when a patch conveyed from the upstream passes a downstream transfer unit, a downstream transfer electric field is weakened so that the amount of a toner image to be retransferred in the downstream transfer unit is reduced, and thereafter, density of the patch on which the toner image is transferred is detected and a developing condition of the toner image to be formed on the upstream is changed.

However, in the apparatus described above, if the toner image for adjustment is detected in a condition in which colors do not overlap each other, the toner image for adjustment formed on the upstream photoreceptor is detected in a condition different from a condition in which a color image is formed on the recording material due to the amount of retransferred toner image on the downstream photoreceptor. In that case, since detection of the toner image for adjustment is not performed in a condition in which color image formation is reproduced, there is a possibility that density adjustment in color image formation is not properly performed using the toner image for adjustment. Although the foregoing description is related to a configuration in which a plurality of photoreceptors are in contact with the intermediate transfer member as an image bearing member which carries a toner image, the same problem may exist in a configuration in which a plurality of photoreceptors are in contact with a recording material conveyance member which conveys a recording material.

SUMMARY OF THE INVENTION

Image forming apparatus includes: a movable image bearing member which carries a toner image; a first image forming unit, which includes a first photoreceptor, and the first photoreceptor is charged and exposed and then a toner image is developed and the first image forming unit forms a toner image to the image bearing member; a second image forming unit which is disposed further downward than the first image forming unit in a direction in which the image bearing member is moved, and which includes a second photoreceptor, and the second photoreceptor is charged and exposed and then a toner image is developed and the second image forming unit forms a toner image to the image bearing member; a detection member which is disposed further downward than the second image forming unit in the direction in which the image bearing member is moved, and which detects a toner image for adjustment which is formed on the image bearing member; an execution unit which is capable of executing a first detection mode and a second detection mode, the first detection mode is a mode in which the toner image for adjustment is formed on the image bearing member by the first image forming unit, then the toner image for adjustment on the image bearing member is carried facing an area of the second photoreceptor which has a first electrical potential and is not developed, the toner image for adjustment on the image bearing member is detected by the detection member, and a second detection mode is a mode in which the toner image for adjustment is formed on the image bearing member by the first image forming unit, then the toner image for adjustment on the image bearing member is carried facing an area of the second photoreceptor which has a second electrical potential and is not developed, the toner image for adjustment on the image bearing member is detected by the detection member, the absolute value of the second electrical potential is smaller than the absolute value of the first electrical potential; and an adjustment unit which adjusts an image formation condition for image formation of the first image forming unit, in accordance with the detection result of the first detection mode performed before the image formation, regarding among images corresponding to the toner images formed by the first image forming unit during image formation an image in which a toner image formed on the image bearing member is not overlapped a toner image formed in the second image forming unit, and in accordance with the detection result of the second detection mode performed before the image formation, regarding among images corresponding to the toner images formed by the first image forming unit during image formation an image in which a toner image formed on the image bearing member is overlapped a toner image formed in the second image forming unit.

In an image forming apparatus in which a plurality of photoreceptors are in contact with an image bearing member and a toner image for adjustment on the image bearing member is detected to adjust image density, it is possible to reduce that the toner image for adjustment formed on the upstream photoreceptor is detected in a condition different from a condition in which a color image is formed. A further object of the present invention will be obvious from the following description.

Further features of the present invention will become apparent from the following description of exemplary embodiments with reference to the attached drawings.

DESCRIPTION OF THE EMBODIMENTS

First Embodiment

Image Formation Process

Figure 1:
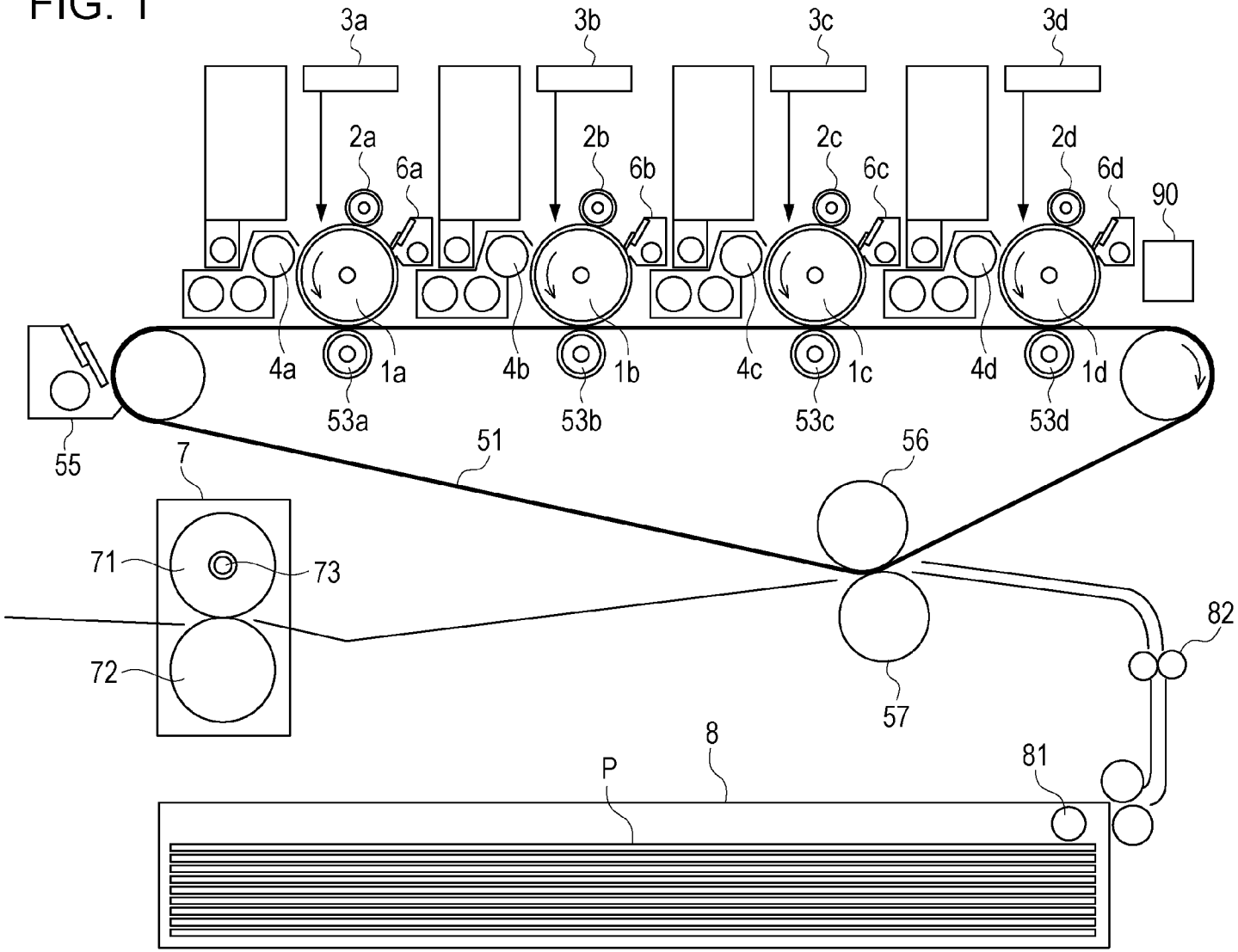
FIG. 1 is a diagram schematically illustrating a configuration of image forming apparatus of the present invention.

FIG. 1 schematically illustrates an image forming apparatus according to a first embodiment of the present invention. The image forming apparatus of the present invention is a full color electrophotographic image forming apparatus which includes an intermediate transfer member and four image forming stations. The intermediate transfer member functions as a movable image bearing member which carries a toner image. Each of the four image formation stations functions as an image forming unit which forms a toner image on the intermediate transfer member. Hereinafter, the image forming apparatus of the present invention will be described in detail.

Photosensitive drums 1*a*, 1*b*, 1*c* and 1*d*, which are separately exposed, are disposed in respective image formation stations Pa, Pb, Pc and Pd for forming yellow, magenta, cyan and black color image. The photosensitive drums 1*a*, 1*b*, 1*c* and 1*d* are rotatable in the arrow direction. Charging units 2*a*, 2*b*, 2*c* and 2*d* for charging the photosensitive drums, exposure units 3*a*, 3*b*, 3*c* and 3*d* with which the photosensitive drums are exposed, developing units 4*a*, 4*b*, 4*c* and 4*d* for developing the toner image, and cleaners 6*a*, 6*b*, 6*c* and 6*d* are arranged on the periphery of respective photosensitive drums 1*a*, 1*b*, 1*c* and 1*d* sequentially in a direction in which the photosensitive drums are rotated.

Figure 2:
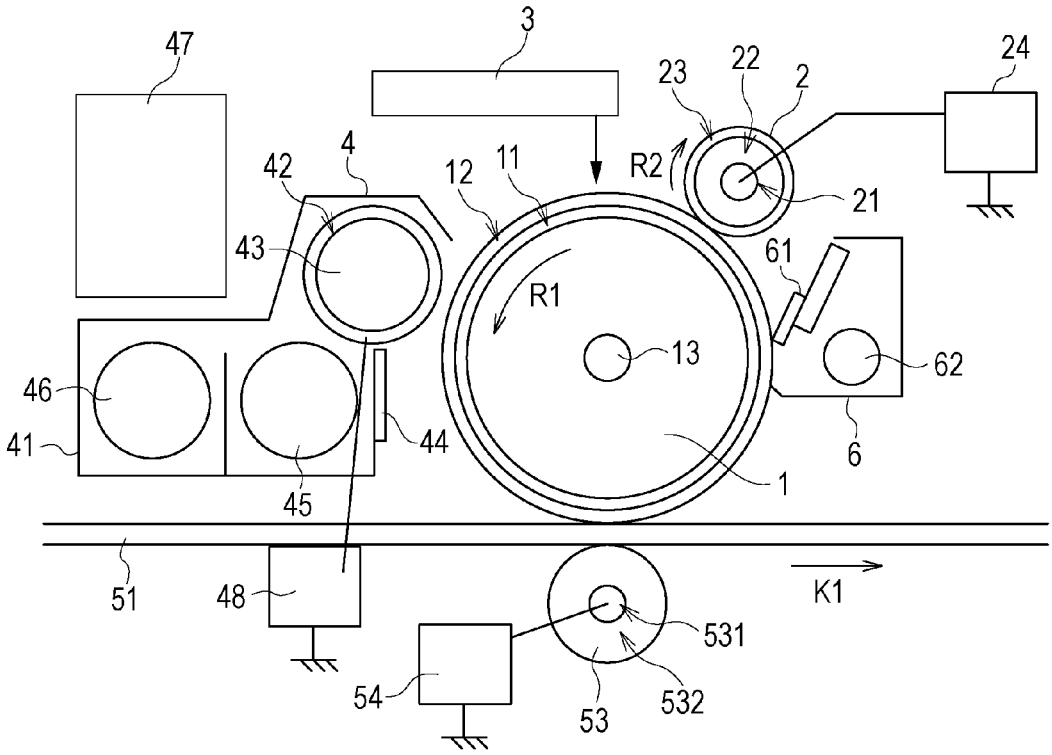
FIG. 2 is a diagram schematically illustrating a configuration of an image formation station of the image forming apparatus of the present invention.

Hereinafter, with reference to FIG. 2, the image formation stations will be described in detail. Four image formation stations are the same in configuration. In description, the reference numerals a, b, c and d are omitted.

Each image formation station includes a photosensitive drum 1 which is rotatably supported by a main body of the apparatus which is not illustrated. The photosensitive drum 1 is a cylindrical-shaped OPC photoreceptor which includes, as main components, a conductive base 11 and a photoconductive layer 12. The conductive base 11 is made of, for example, aluminum. The photoconductive layer 12 is formed on an outer periphery of the conductive base 11. The photosensitive drum 1 includes a shaft 13 at the center thereof and is driven to rotate in the direction of arrow R1 about the shaft 13 by a driving unit which is not illustrated.

A charging roller 2 is disposed above the photosensitive drum 1. The charging roller 2 functions as a charging unit which charges the photosensitive drum 1. The charging roller 2 is in contact with a surface of the photosensitive drum 1 and charges the surface of the photosensitive drum 1 uniformly to predetermined polarity and electrical potential. The charging roller 2 includes a conductive core metal 21, a low-resistance conductive layer 22 and a middle-resistance conductive layer 23. The conductive core metal 21 is disposed at the center of the charging roller 2. The low-resistance conductive layer 22 is formed on an outer periphery of the core metal 21. Both end portions of the core metal 21 are rotatably supported by a bearing member which is not illustrated. The bearing member of both the end portions is urged toward the photosensitive drum 1 by a pressure unit which is not illustrated. That is, the charging roller 2 is pressed against the surface of the photosensitive drum 1 with predetermined pressure force. The charging roller 2 is driven to rotate in the direction of arrow R2 when the photosensitive drum 1 is rotated in the direction of arrow R1. Voltage is applied to the charging roller 2 by a power supply 24. The surface of the photosensitive drum 1 is thus charged uniformly.

The exposure unit 3 which exposes the photoreceptor 1 is disposed in the downstream of the charging roller 2 in the direction in which the photosensitive drum 1 is rotated. The photosensitive drum 1 is scanned by a laser beam which is turned on and off in accordance with image information by the exposure unit 3. Thus, an electrostatic latent image in accordance with the image information is formed on the photosensitive drum 1.

A developing unit 4 which develops the toner image on the electrostatic latent image is disposed on the downstream from the exposure unit 3 in the rotation direction of the photosensitive drum 1. The developing unit 4 includes a developing container 41 and a developing sleeve 42. In the developing container 41, a two-component developer is contained. The developing sleeve 42 is disposed within an opening of the developing container 41 which faces the photosensitive drum 1 and which is rotatable. A magnet roller 43 is disposed fixedly in the developing sleeve 42 so as not to be rotated with the rotation of the developing sleeve 42. The magnet roller 43 causes the developing sleeve 42 to carry the developer. A regulation blade 44 is disposed in the developing container 41 below the developing sleeve 42. The regulation blade 44 regulates the developer carried on the developing sleeve 42 so as to form a thin developer layer. A development chamber 45 and an agitation chamber 46 which are divided from each other are provided in the developing container 41. A supply chamber 47 in which toner for supply is contained is provided above the development chamber 45 and the agitation chamber 46. When the developer formed on the thin developer layer is conveyed to a development area which faces the photosensitive drum 1, magnetic force of a developing main pole disposed in the development area of the magnet roller 43 causes a carrier chain to be formed. Therefore, a magnetic brush of the developer is formed. When the magnetic brush rubs the surface of the photosensitive drum 1 and developing bias voltage is applied to the developing sleeve 42 by a power supply 48, the toner adhering to the carrier which constitutes hair of the magnetic brush adheres to the exposure unit of the electrostatic latent image. Then, the toner image is developed on the photosensitive drum 1.

A primary transfer roller 53 is disposed below the photosensitive drum 1 on the downstream of the developing unit 4. The primary transfer roller 53 is used to transfer the toner image from the photosensitive drum 1 to an intermediate transfer belt 51. The transfer roller 53 includes a core metal 531 and a conductive layer 532. A power supply 54 applies bias to the core metal 531. The conductive layer 532 is formed on an outer periphery of the core metal 531. Both end portions of the primary transfer roller 53 are urged toward the photosensitive drum 1 by a pressing member, such as a spring, which is not illustrated. That is, the conductive layer 532 of the primary transfer roller 53 is pressed against the surface of the photosensitive drum 1 via the intermediate transfer belt 51 with predetermined pressure force. Therefore, a transfer nip unit is formed between the photosensitive drum 1 and the primary transfer roller 53. The power supply 54 applies, to the primary transfer roller 53, transfer voltage of which polarity is opposite to that of the toner. Therefore, the toner image on the photosensitive drum 1 is transferred to a surface of the intermediate transfer belt 51 by the transfer nip unit.

After the toner image is transferred, substances adhering to the photosensitive drum, such as toner, are removed by the cleaner 6. The cleaner 6 includes a cleaner blade 61 and a conveyance screw 62. The cleaner blade 61 is pressed against the photosensitive drum 1 at a predetermined angle and with predetermined pressure by a pressurizing unit which is not illustrated so as to collect the toner remaining on the surface of the photosensitive drum 1. The collected residual toner is conveyed by the conveyance screw 62.

Next, an image formation process is described with reference to FIG. 1. The toner images of each color formed on the photosensitive drums 1*a*, 1*b*, 1*c* and 1*d* are sequentially transferred to the intermediate transfer belt 51 by the primary transfer roller 53*a*, 53*b*, 53*c* and 53*d*. The toner images are conveyed to a secondary transfer unit at which the toner images are transferred to a recording material. The secondary transfer unit includes a secondary transfer outer roller 57 and a secondary transfer inner roller 56. The secondary transfer outer roller 57 is used to transfer the toner image from the intermediate transfer belt 51 to the recording material. The secondary transfer inner roller 56 is disposed to face the secondary transfer outer roller 57. The intermediate transfer belt 51 is wound around the secondary transfer inner roller 56.

A recording material P contained in a paper cassette 8 is fed to a conveying roller 82 via a pickup roller 81. Then, the recording material P is conveyed to the secondary transfer unit at the same time when the toner image reaches the secondary transfer unit. Transfer voltage is applied to the secondary transfer outer roller 57. The toner image on the intermediate transfer belt 51 is transferred to the recording material P by a transfer electric field formed between the secondary transfer inner roller 56 and the secondary transfer outer roller 57. The toner which is not transferred to the recording material in the secondary transfer unit but remained on the intermediate transfer belt 51 is removed by the intermediate transfer belt cleaner 55.

The recording material with the toner image transferred thereon is conveyed to a fusing device 7 in which the toner image is fused. The fusing device 7 includes a toner image fusing roller 71 and a pressure roller 72. The toner image fusing roller 71 includes a heater 73 and is configured to be rotatable. The pressure roller 72 is rotatable in a condition in which it is pressed against the toner image fusing roller 71. With pressure and heat by the fusing device 7, the unfixed toner image on the recording material is fused and is fixed to the recording material. A full color image is thus formed on the recording material P.

Figure 12:
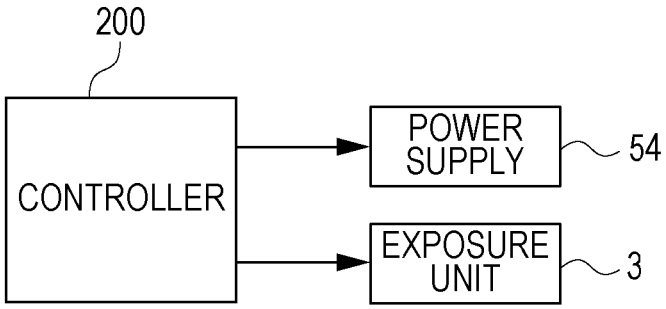
FIG. 12 is a block diagram of the present invention.

The above-described image formation process is controlled by a controller 200 (see FIG. 12). The controller 200 includes a CPU, RAM and ROM, and controls the entire image formation process. That is, the controller 200 sets a voltage value of transfer voltage applied to the primary transfer roller 53 by the power supply 54 and an exposure output value by the exposure unit 3.

Regarding electrical potential of each configuration, transfer voltage is positive whereas the toner is negative. The exposure unit electrical potential, development electrical potential and the charging unit electrical potential, for example, are negative.

The intermediate transfer belt 51 is made of dielectric resin, such as PC, PET and PVDF. In the present embodiment, PI resin of which volume resistivity is $10^{8.5}$ Ω·cm (a probe complying with JIS-K6911, applied voltage: 100 V, applied time: 60 sec, 23 degrees. C, 50% RH) and thickness t=100 micrometers is used. Other materials, volume resistivity and thickness may be employed.

The primary transfer roller 53 is formed by a ϕ8 mm core metal and a 4-mm-thick conductive urethane sponge layer. Resistance of the primary transfer roller 53 is about $10^5$Ω (23 degrees. C, 50% RH). An electric resistance value of the primary transfer roller 53*a* is obtained from a current value which is measured in the following manner. The primary transfer roller 53*a* in contact with a metal roller grounded is made to move at a peripheral speed of 50 mm/sec under the load of 500 g, and constant voltage of 500V is applied to the core metal 531.

Detection Unit

For the density control of an image, in the present embodiment, after a toner image for adjustment is formed on the intermediate transfer member, the toner image for adjustment is irradiated with light and intensity of a diffuse component is detected. Then, an image formation condition is adjusted in accordance with the detection result.

Figure 6:
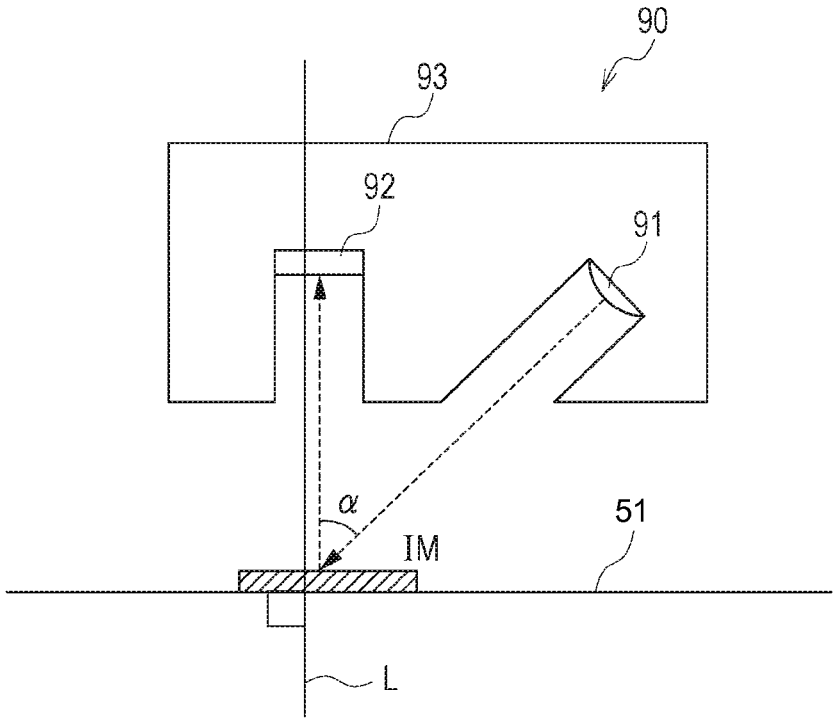
FIG. 6 is a diagram schematically illustrating a configuration of a density detection unit of the present invention.

An optical density sensor 90 is provided as a detection unit to detect a toner image for adjustment. As illustrated in FIG. 1, the optical density sensor 90 is disposed to face the intermediate transfer belt 51 at a position downstream from the image formation station Pd, which is the most downstream image formation station, and is upstream from the secondary transfer unit in the direction in which the intermediate transfer belt 51 is rotated. As illustrated in FIG. 6, the optical density sensor 90 includes an LED 91, a photodiode 92, and a support member 93. The LED 91 is a light-emitting device. The photodiode 92 is a photodetector. The support member 93 supports the LED 91 and the photodiode 92.

Positions of the photodetector 92 and the light-emitting device 91 are set such that the photodetector 92 receives only diffuse light but does not receive specular light. That is, the light-emitting device is disposed such that an irradiation angle α at which the light-emitting device emits light is 45 degrees with respect to the normal line L vertical to a belt surface of the intermediate transfer belt. The photodetector is disposed such that the light receiving angle of the photodetector is 0 degrees with respect to the normal line L.

The light-emitting device 91 irradiates the toner image for adjustment on the intermediate transfer belt 51 with infrared light, and the photodetector 92 receives a diffuse component of the light backscattered from the toner image for adjustment. The density of an image for detection DP is determined in accordance with the light intensity received by the photodetector 92.

Detection result is sent to the controller 200. The controller 200 adjusts image formation conditions, such as exposure output of the exposure unit 3, in accordance with the detection result. That is, the controller 200 functions as the adjustment unit which adjusts the image formation condition.

Density Control for Multi-Color Image Formation

Figure 7:
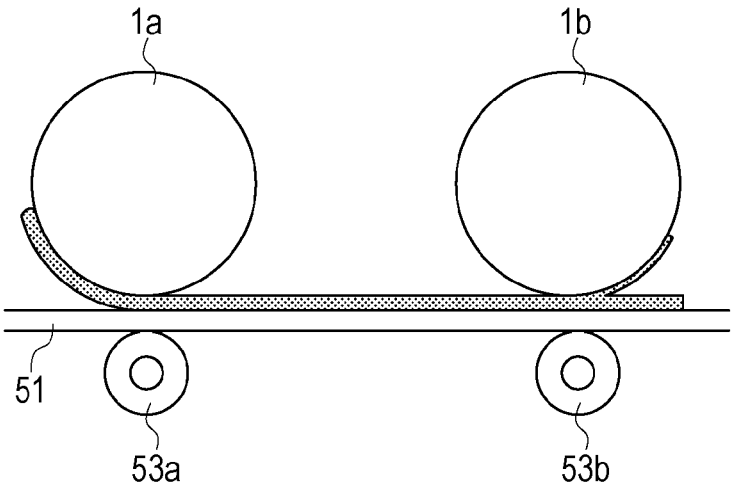
FIG. 7 is a diagram illustrating a retransfer phenomenon of the present invention.

Density control for multi-color image formation in the present embodiment will be described. In the image forming apparatus in which multiple transfer using an intermediate transfer member is performed as in the present embodiment, a phenomenon called "retransfer" occurs. FIG. 7 is a schematic diagram illustrating the retransfer. A toner image formed on the photosensitive drum 1*a* of the yellow image formation station Pa is transferred to the intermediate transfer belt 51. The toner image is again transferred from the intermediate transfer belt 51 to the photosensitive drum 1*b* of the magenta image formation station Pb which is the next downstream image formation station of the yellow image formation station.

Figure 8A:
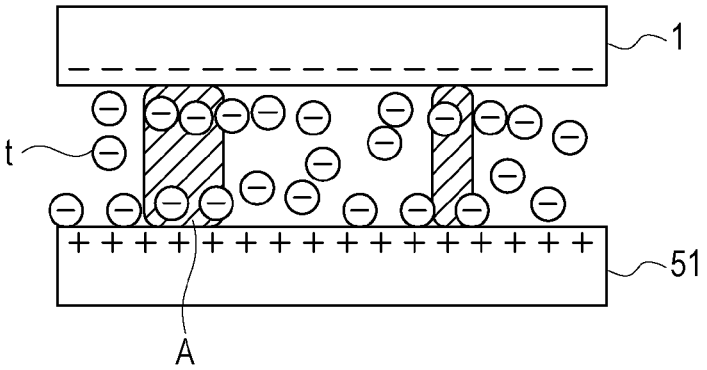
FIGS. 8A and 8B are diagrams illustrating the retransfer phenomenon of the present invention.
Figure 8B:
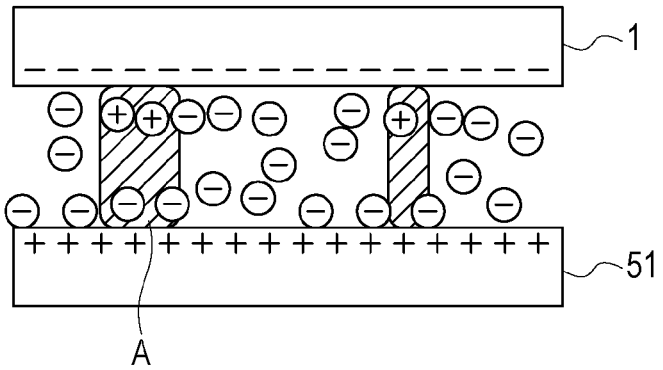

A cause for the retransfer will be discussed with reference to FIGS. 8A and 8B. As illustrated in FIG. 8A, in a transfer nip unit between the photosensitive drum 1 and the intermediate transfer belt 51, the surface of the photosensitive drum 1 is negatively charged and the surface of the intermediate transfer belt 51 is positively charged. In the transfer nip unit, however, a gap in which an electrical discharge threshold is exceeded and an area A in which a condition that a potential difference may be produced is satisfied may exist. If electrical discharge occurs in the area A, a part of the toner is positively charged as illustrated in FIG. 8B. The positively charged toner is electrostatically attracted to the negatively charged photosensitive drum 1. That is, retransfer occurs. The larger the difference between the transfer voltage applied to the primary transfer roller and surface potential of the photosensitive drum (i.e., transfer contrast), the easier the potential difference exceeding the electrical discharge threshold (discharge starting voltage) is caused. Therefore, the number of electrical discharge is increased and an amount of toner to be retransferred is increased.

Figure 9:
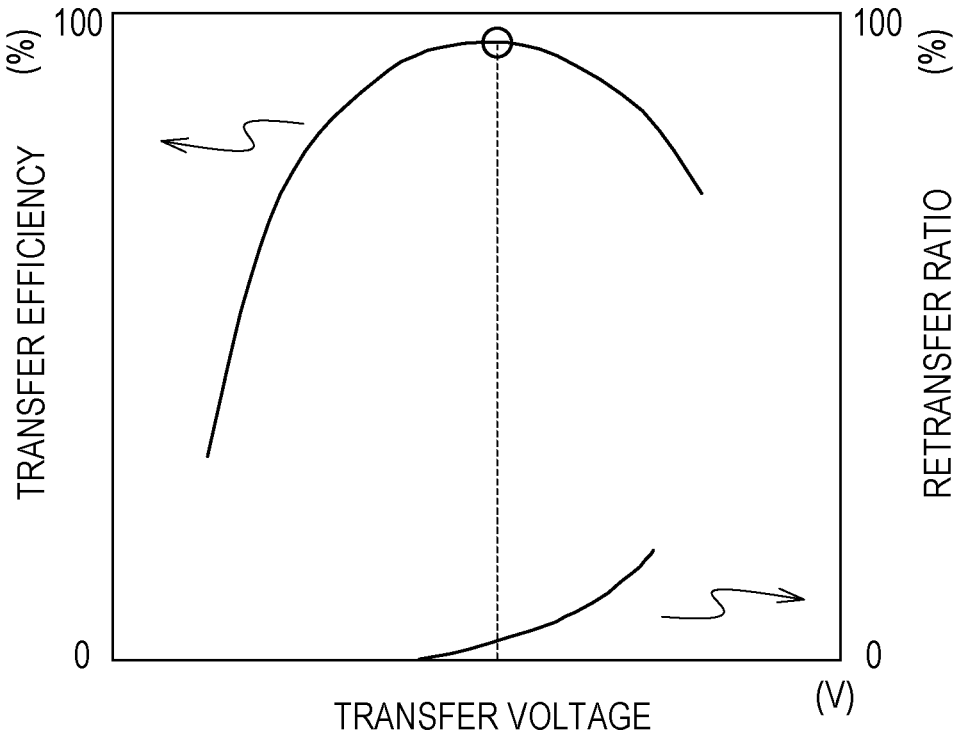
FIG. 9 is a diagram illustrating a relationship between transfer and retransfer of the present invention.

FIG. 9 illustrates a relationship among voltage applied to the transfer roller 53*b* of the magenta image formation station Pb, transfer efficiency with which a magenta toner image is transferred from the photosensitive drum 1*b* to the intermediate transfer belt 51, and a ratio at which a yellow toner image is retransferred from the intermediate transfer belt 51 to the photosensitive drum 1*b*. As illustrated in FIG. 9, as the transfer voltage is raised, the transfer efficiency of the magenta toner image is increased. The transfer efficiency is saturated when certain transfer voltage is reached. The transfer efficiency is decreased in areas with greater transfer voltage. The smallest voltage value at which retransfer is caused is smaller than the voltage value at which the transfer efficiency is saturated. This means that achieving the highest transfer efficiency and preventing occurrence of the retransfer are not compatible. Therefore, the transfer voltage at the time of imaging is set to a range in which a slight amount of retransfer occurs in consideration of the balance of transfer efficiency and retransfer.

Figure 3:
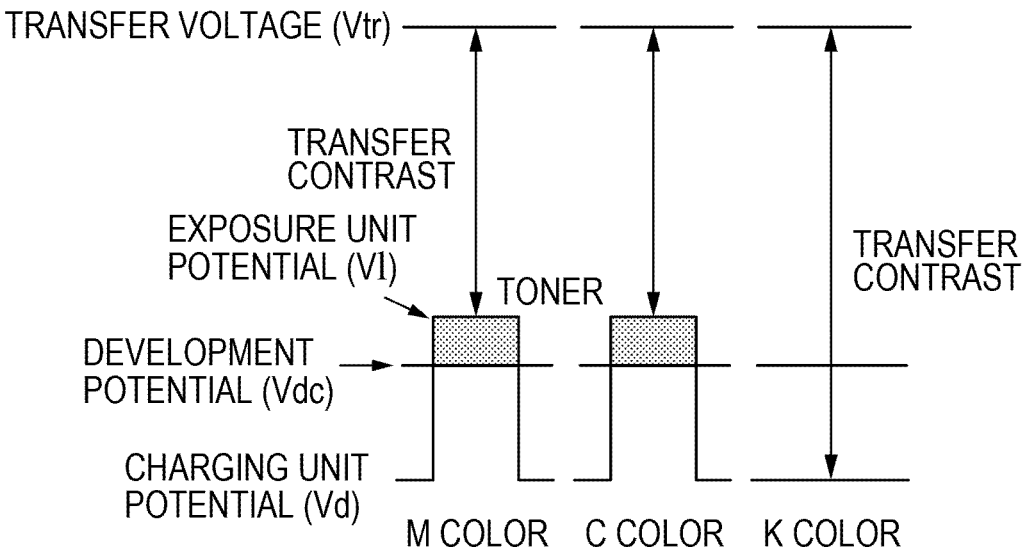
FIG. 3 is a diagram illustrating photosensitive drum surface potential and transfer bias of the present invention.

If the retransfer occurs, the following problems may be caused. If a color image is formed, toner may be overlapped with each other to reproduce a multi-color image, such as secondary color. For example, blue color as secondary color is obtained by overlapping magenta and cyan. The magenta toner on the photosensitive drum 1*b* (first photoreceptor) is transferred to the intermediate transfer belt 51, and then, the cyan toner on the photosensitive drum 1*c* (second photoreceptor) is transferred to the magenta toner in an overlapped manner. In this case, when the magenta toner passes the transfer unit of the cyan imaging unit, retransfer to the photosensitive drum hardly occurs. The reason for which is discussed below. In a range in which blue color is to be expressed as a secondary color, since cyan toner is overlapped the magenta toner, the magenta toner on the intermediate transfer belt faces the cyan toner on the image bearing member in the transfer unit. As illustrated in FIG. 3, in an area in which the cyan toner is carried, the surface potential of the photosensitive drum is the exposure unit electrical potential (V1) by being exposed. That is, since the potential difference between the surface potential of the photosensitive drum and the transfer voltage (Vtr) is small, electrical discharge is not easily caused between the photosensitive drum which carries the cyan toner and the intermediate transfer belt which carries the magenta toner in the transfer unit. Therefore, polarity reversal of the magenta toner due to electrical discharge is hardly caused.

Figure 4:
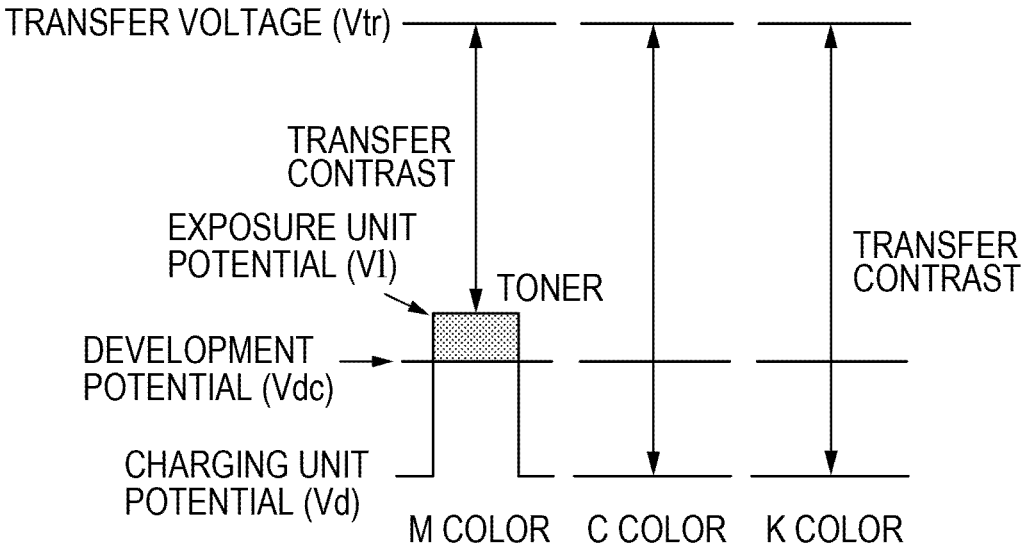
FIG. 4 is a diagram illustrating the photosensitive drum surface potential and the transfer bias of the present invention.

If single magenta color is to be expressed, retransfer to the photosensitive drum of the magenta toner occurs relatively often. The reason for which is discussed below. If the single magenta color is to be expressed, the magenta toner and the cyan toner do not overlap each other. Therefore, the magenta toner on the intermediate transfer belt faces the area on the photosensitive drum which does not carry the cyan toner. As illustrated in FIG. 4, the surface potential of the photosensitive drum on which a cyan toner image is not formed is the charging unit electrical potential (Vd). Since the potential difference between the surface potential of the photosensitive drum and the transfer voltage (Vtr) is large, electrical discharge between the photosensitive drum and the intermediate transfer belt which carries magenta toner is easily caused in the transfer unit. Therefore, polarity reversal of the magenta toner due to electrical discharge is caused and the toner with reversed polarity is retransferred.

Therefore, although the same image data is input in the same page, density of the magenta toner image differs depending on whether another toner image overlaps the magenta toner image. That is, density of single color is low and density of multi-color is high. This phenomenon may occur not only in the magenta toner image but in the cyan and yellow toner images. Therefore, not only density stability kept by density control is impaired but subtle color reproduction is disturbed.

Then, a method is considered in which density is increased in consideration of the density which has been lowered due to the occurrence of the retransfer in the case of expressing the single color. However, an amount of overlapping toner of the multi-color is significantly large since retransfer hardly occurs in a single-color region. Therefore, there may be problems that the density of a multi-color region is excessively high, scattering of the image occurs and fixation becomes insufficient. Even if a design is made so as to reduce the amount of overlapping toner in consideration of the above-described phenomenon. The amount of retransfer varies significantly depending on the environmental condition, the frequency in use of the photosensitive drum, the amount use, the frequency in use of the developing unit, and the amount use. This is because the characteristic of the toner, especially the amount of charge kept by the toner is changed in accordance with the condition described above. That is, variation in the amount of retransfer causes considerable variation in the multi-color density, whereby it becomes difficult to keep the balance of the entire color image.

Then, in the present embodiment, a mode in which a M-color test patch is detected for the correction of the density of the M-color toner as single color ("first detection mode") and a mode in which the M-color test patch is detected for the correction of the density of the toner image of blue color as a multi-color in which M color and C color are made to overlap each other ("second detection mode") are executed. In order to stabilize output image density, electrical potential of the drum is changed in each mode, and toner detection is performed in a condition closer to that during imaging. Regarding the single-color region, an image formation condition (exposure output) is adjusted in accordance with a detection result of the first detection mode. Regarding the multi-color region, an image formation condition (exposure output) is adjusted in accordance with the detection result in the second detection mode. The adjustment modes are controlled by the controller 200. That is, the controller 200 functions as an execution unit which may execute the detection modes. The procedure will be discussed below.

Correction of Image Density of Single Magenta Color

First, a procedure related to a first detection mode in which toner is detected for the correction of image density about a single-color region will be described. Here, a case in which the single color is magenta is described.

1) Five test patches of image signals with varied image density in 5% increments from about 30% to 50% of magenta color are formed on the photosensitive drum 1*b* in FIG. 1.

2) The M-color test patches formed on the photosensitive drum 1*b* are sequentially transferred to the intermediate transfer belt 51 by the primary transfer roller 53*b*. The M-color test patches on the intermediate transfer belt are conveyed in contact with the photosensitive drums 1*c* and 1*d* of the downstream imaging units. The potential of the surfaces of the photosensitive drums 1*c* and 1*d* at this time are the potential of the non-image area at the time of imaging, i.e., the charging unit potential (Vd). The relationship of the potentials is illustrated in FIG. 4.

3) The M-color test patches primarily transferred to the intermediate transfer belt 51 illustrated in FIG. 1 are detected by the optical density sensor 90 which is disposed facing the intermediate transfer belt 51. That is, the M-color test patches are detected in a condition in which the M-color toner in the single-color region during image formation is reproduced.

4) An image signal closest to the target optical density of the M-color test patches is calculated in accordance with an optical density measurement result about a plurality of M-color test patches and an image formation condition of the image signal is controlled. That is, regarding the single-color region, a relationship between the M-color image density and the exposure output is obtained successfully. With the above procedure, it is possible to secure the image density about the single-color region.

Correction of Density of Toner Image in which M Color and C Color Overlap

Next, the second detection mode which detects the toner for the correction of image density about the multi-color region will be described. Here, the description will be given in which the multi-color is the blue color obtained by overlapping M color and C color. Even if the test patch on which M color and C color are made to overlap is formed for the correction of the density of the toner image in which the M color and C color overlap each other, it is not possible that the optical density sensor 90 detects the toner amount of M color and the toner amount of C color at the same time. Then, in the second detection mode, after the M-color test patch and the C-color test patch are formed independently from each other and then detected.

1) Five test patches of image signals with varied image density in 5% increments from about 30% to 50% of magenta color are formed on the photosensitive drum 1*b* in FIG. 1.

Figure 5:
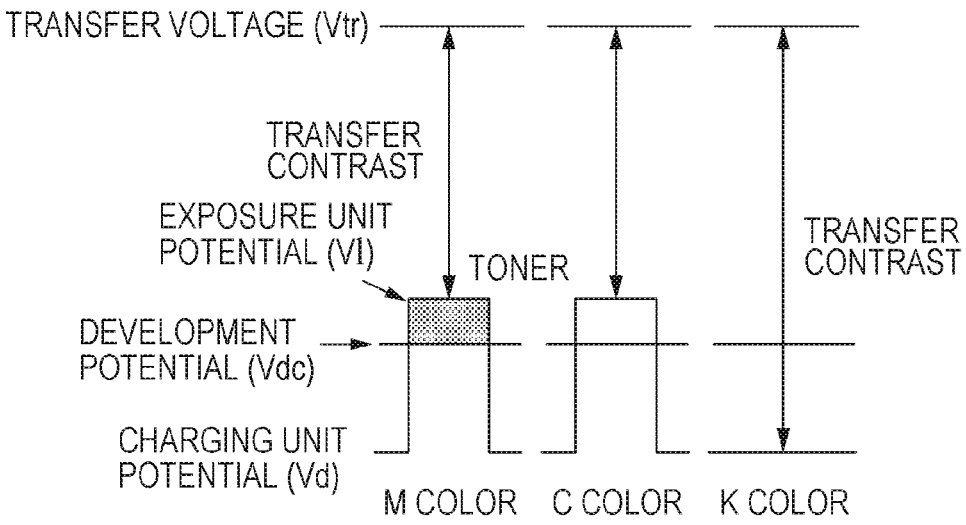
FIG. 5 is a diagram illustrating the photosensitive drum surface potential and the transfer bias of the present invention.

2) The M-color test patches formed on the photosensitive drum 1*b* are sequentially transferred to the intermediate transfer belt 51 by the primary transfer roller 53*b*. The M-color test patches on the intermediate transfer belt are conveyed in contact with the photosensitive drums 1*c* and 1*d* of the downstream imaging units. As illustrated in FIG. 5, electrical potential of the surface of the photosensitive drum 1*c* corresponding to cyan at this time is the electrical potential of an image area at the time of imaging, i.e., the exposure unit electrical potential (V1). When the area of the exposure unit electrical potential (V1) of the photosensitive drum 1*c* passes the developing position, AC bias of development bias is turned off so that the M-color toner image is not developed on the photosensitive drum 1*c* and, further, rotation of the developing sleeve is stopped. Then, DC bias of the development bias is also turned off. That is, a condition of the surface of the photosensitive drum 1*c* is that, although the surface is exposed, the toner is not developed. Potential of the surface of the photosensitive drum 1*d* which corresponds to black is the electrical potential of the non-image area at the time of imaging, i.e., the charging unit electrical potential (Vd).

3) The M-color test patches primarily transferred to the intermediate transfer belt 51 illustrated in FIG. 1 are detected by the optical density sensor 90 which is disposed facing the intermediate transfer belt 51. That is, the M-color test patch is detected in a condition in which retransfer of the M-color toner is reproduced in the blue color region as the multi-color region.

4) An image signal closest to the target optical density of the M-color test patches is calculated in accordance with an optical density measurement result about a plurality of M-color test patches and an image formation condition corresponding to the image signal is employed. That is, regarding the blue color region as the multi-color region, the relationship between the M-color image density and the exposure output is obtained successfully.

5) Then, cyan test patches are formed on the photosensitive drum 1*c*. In the same procedure as described above, the image signal closest to the target optical density of the C-color test patch is calculated in accordance with the optical density measurement result of a plurality of C-color test patches, and the image formation condition is employed. That is, regarding the blue color region as the multi-color region, the relationship between the C-color image density and the exposure output is obtained successfully.

As described above, if the density of the toner image in which M color and C color are made to overlap each other is corrected, detection of the M-color test patch is performed in a condition in which the M-color toner is not easily retransferred in the C-color transfer unit similarly at the normal imaging is reproduced. Detection of the C color test patch is performed in a condition in which a condition under which retransfer is usually caused in the transfer unit of K color similarly at the normal imaging is reproduced. That is, by obtaining an image signal optimum for each case, it is possible to achieve stable density without any effects of the retransfer even in the secondary color.

In the present embodiment, although specific procedures regarding test patterns for the single magenta color and blue halftone have been described, the present embodiment is not limited to the same. For example, the method of the present invention may be applied to secure the density of three, M, C and K multi-color image.

The present invention is more effective if the exposure unit electrical potential in the downstream imaging unit is the exposure unit electrical potential considered for halftone regions than if the exposure unit electrical potential is full exposure unit electrical potential considered for solid regions. Since the contrast between the exposure unit electrical potential of the solid region and the transfer voltage is small, the exposure unit electrical potential of the solid region may be equal to or lower than the discharge starting voltage. That is, this condition in which retransfer hardly occurs may be reproduced also by reducing the transfer bias. Average exposure unit electrical potential of the halftone region is close to the charging unit electrical potential Vd, and the contrast with the transfer voltage exceeds the discharge starting voltage. This causes retransfer. It is difficult to reproduce this condition precisely by reducing the transfer bias. The method of the present invention may reproduce the condition of the retransfer more precisely and is more effective.

In the present embodiment, stability in color is maintained by performing density control of the above-described procedure once in every 100 sheets printed. Frequency of control is not limited to the same.

In the present embodiment, the test patterns are detected by the optical density sensor 90 which is disposed to face the intermediate transfer belt 51. However, this configuration is not restrictive. The same control may be carried out in a configuration in which density of the test patterns transferred to a transfer material, such as a paper sheet, may be read by a reading device, such as a reader, and image density may be corrected.

The present embodiment has a configuration in which a plurality of photoreceptors are made to be in contact with the intermediate transfer member which functions as an image bearing member which carries the toner image. However, this configuration is not restrictive. A plurality of photoreceptors may be in contact with the recording material conveyance member which conveys the recording material.

Second Embodiment

Since a second embodiment of the present invention is apparatus identical to that of the first embodiment except for a part of control, detailed description of the apparatus and the image formation process will be omitted.

The present embodiment is to perform control to correct image density of a toner image of blue color as a multi-color obtained by making M color and C color overlap each other, especially M-color test patches are to be detected, in consideration of an influence of cyan toner which is made to overlap in the actual imaging process. The procedure will be discussed below.

1) Five test patches of image signals with varied image density in 5% increments from about 30% to 50% of magenta color are formed on the photosensitive drum 1*b* in FIG. 1.

Figure 10:
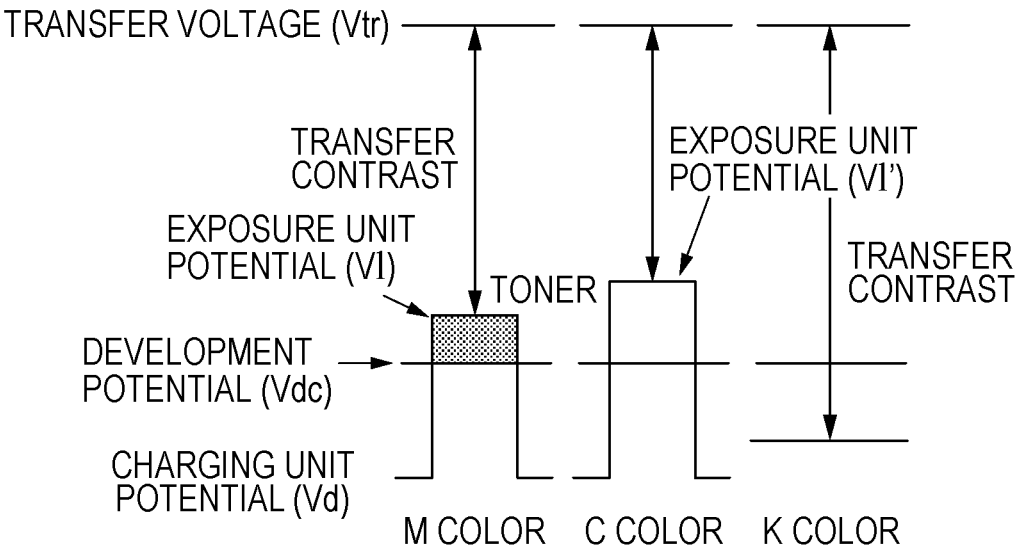
FIG. 10 is a diagram illustrating photosensitive drum surface potential and transfer bias of another embodiment of the present invention.

2) The M-color test patches formed on the photosensitive drum 1*b* are sequentially transferred to the intermediate transfer belt 51 by the primary transfer roller 53*b*. The M-color test patches on the intermediate transfer belt are conveyed in contact with the photosensitive drums 1*c* and 1*d* of the downstream imaging units. As illustrated in FIG. 10, electrical potential of the surface of the photosensitive drum 1*c* corresponding to cyan at this time is the electrical potential of an image area at the time of imaging, i.e., the electrical potential (V1') which is even lower than the exposure unit electrical potential (V1). That is, the absolute value of the electrical potential of the surface of the photosensitive drum 1*c* corresponding to the cyan color is usually smaller than the absolute value of the electrical potential at the time of imaging. This is because the amount of the electrical potential corresponding to the electrical potential for which the transfer contrast is canceled in an actual configuration in which the cyan toner layer exists is offset. When the area of the exposure unit electrical potential (V1) of the photosensitive drum 1*c* passes the developing position, AC bias of development bias is turned off so that the toner image is not developed on the photosensitive drum 1*c* and, further, rotation of the developing sleeve is stopped. Electrical potential of a surface of a photosensitive drum 1*d* which corresponds to black is the charging unit electrical potential (Vd'), which is the amount of the electrical potential corresponding to the electrical potential for which the transfer contrast is canceled in an actual configuration in which the cyan toner layer exists, with respect to the electrical potential of the non-image area at the time of imaging, i.e., charging unit electrical potential (Vd). That is, the absolute value of the electrical potential of the surface of the photosensitive drum 1*d* corresponding to the black color is usually smaller than the absolute value of the charging unit electrical potential during image formation.

In the subsequent processes, density correction is performed by the same procedure as that of the first embodiment. As described above, if the image density of the toner image of blue color in which M color and C color are made to overlap each other is corrected, detection of the M-color test patch is performed in a condition in which the M-color toner is not easily retransferred in the C-color transfer unit similarly at the normal imaging is reproduced. Therefore, even in the secondary color, it is possible to obtain stable density without any influence of the retransfer.

Figure 11:
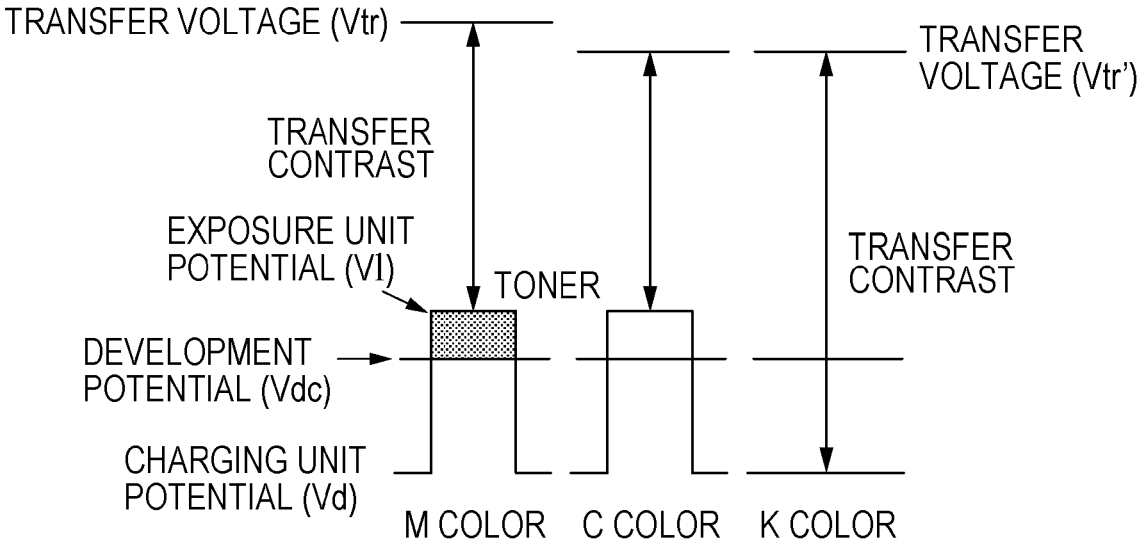
FIG. 11 is a diagram illustrating the photosensitive drum surface potential and the transfer bias of another embodiment of the present invention.

In the above-described procedure (2), as illustrated in FIG. 11, it is also possible to set the transfer bias to be transfer voltage (Vtr') to offset the electrical potential corresponding to the electrical potential for which the transfer contrast is canceled in an actual configuration in which the cyan toner layer exists.

As described above, in the present embodiment, in performing density correction of the multi-color toner image, accurate correction may be made by causing a condition close to an actual imaging condition. Although an embodiment of the present invention has been described, the present invention is not limited to the same: many modifications may be made without departing from the technical idea of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-277690 filed Dec. 19, 2011, which is hereby incorporated by reference herein in its entirety.

What is claimed is:

1. An image forming apparatus comprising:

a movable intermediate transfer member;

a first image forming unit configured to form a first toner image onto the intermediate transfer member, the first toner image being formed according to first image data with an image forming condition with respect to a toner amount of the first toner image;

a second image forming unit configured to form a second toner image onto the intermediate transfer member, and including a photosensitive member, a charging member, an exposure unit, a developing unit, and a transfer member, the charging member charging an electrical potential of the photosensitive member to a first electrical potential, the exposure unit exposing the first electrical potential of the photosensitive member to a second electrical potential to form a latent image according to second image data, the developing unit developing the latent image to form a second toner image, the transfer member transferring the second toner image onto the intermediate transfer member in a transfer portion with a transfer electric field applied thereto, and the second image forming unit being disposed downstream of the first image forming unit with respect to a moving direction of the intermediate transfer member;

a detection member configured to detect a toner image on the intermediate transfer member, and is disposed downstream of the transfer portion with respect to the moving direction of the intermediate transfer member;

an execution portion configured to execute a first mode and a second mode during a non-image forming operation, the first mode being executed with the electrical potential of the photosensitive member overlapped with a test toner image in the transfer portion being set to the first electrical potential in advance, the second mode being executed with the electrical potential of the photosensitive member overlapped with the test toner image in the transfer portion being set to the second electrical potential in advance, the second mode being executed with a condition of the developing unit being set so as not to develop a second electrical potential area of the photosensitive member, and the first mode and the second mode being executed to form the test toner image onto the intermediate transfer member by controlling the first image forming unit, and to detect the test toner image with the detection member after the test toner image has passed through the transfer portion with the transfer electric field applied thereto; and an adjusting portion configured to adjust an image forming condition of non-overlapped image data based on a detection result of the detection member in the first mode during an image forming operation, and to adjust an image forming condition of overlapped image data based on a detection result of the detection member in the second mode during the image forming operation, the non-overlapped image data being included in the first image data and corresponding to the first toner image not overlapped with the second toner image in the transfer portion, and the overlapped image data being included in the first image data and corresponding to the first toner image overlapped with the second toner image in the transfer portion.

2. The image forming apparatus according to claim 1, wherein the image forming condition is a condition for changing a density of the first toner image.

3. The image forming apparatus according to claim 1, wherein the first image forming unit further comprises a first photosensitive member, a first charging member, and a first exposure unit, and wherein the image forming condition is exposure power of the first exposure unit.

4. The image forming apparatus according to claim 1, wherein, in the second mode, an absolute value of the second electrical potential is smaller than an absolute value of an electrical potential of the photosensitive member on which the second toner image is formed during the image forming operation.

5. The image forming apparatus according to claim 1, wherein the execution portion executes the second mode with the second electrical potential that is an electrical potential of the photosensitive member on which a halftone toner image is formed during the image forming operation.

6. The image forming apparatus according to claim 1, wherein the movable intermediate transfer member is an intermediate transfer belt.

7. The image forming apparatus according to claim 1, wherein the detection member is an optical light intensity detection sensor.

8. The image forming apparatus according to claim 1, wherein the image forming apparatus is configured to form a plurality of images which includes a plurality of different colors, and the non-overlapped image data is monochromatic image data and the overlapped image data is multi-color image data.

* * * * *